US005279388A

United States Patent [19]

Laughlin et al.

[11] Patent Number: 5,279,388

[45] Date of Patent: Jan. 18, 1994

[54] TREE CLIMBER OR STEP DEVICE

[75] Inventors: Michael K. Laughlin; Jerry K. Laughlin, both of Paw Paw; Victor A. Laughlin, Gobles, all of Mich.

[73] Assignee: Outback Products, Inc., Gobles, Mich.

[21] Appl. No.: 952,675

[22] Filed: Sep. 25, 1992

[51] Int. Cl.[5] ..... A63B 27/00

[52] U.S. Cl. ..... 182/92; 182/90

[58] Field of Search ..... 182/90, 92, 221, 187; 248/216.1

[56] References Cited

U.S. PATENT DOCUMENTS

| | | | |
|---|---|---|---|
| 907,483 | 12/1908 | Ette | 182/90 |
| 4,378,926 | 4/1983 | Hodack | 248/216.1 X |
| 4,415,061 | 11/1983 | Meyer | 182/92 |
| 4,422,527 | 12/1983 | Schultz et al. | 182/92 |
| 4,700,807 | 10/1987 | Kubrak | 182/92 |
| 5,076,522 | 12/1991 | Stinson | 248/216.1 |

OTHER PUBLICATIONS

Archery '92, Gander Mountain p. 64.
1992 Hunting Catalog, p. 98.
Cabela's 1992 Annual Fall Catalog, p. 177.

*Primary Examiner*—Alvin C. Chin-Shue
*Attorney, Agent, or Firm*—Gordon W. Hueschen

[57] ABSTRACT

A step adapted to be screwed into a tree or post having an exposed threaded segment and a body segment, wherein a lag bolt is securely molded into the body member, the body member preferably comprising a strong plastic, and having certain advantages over existing similar devices due to various aspects of its construction, is described.

5 Claims, 2 Drawing Sheets

FIG. 1
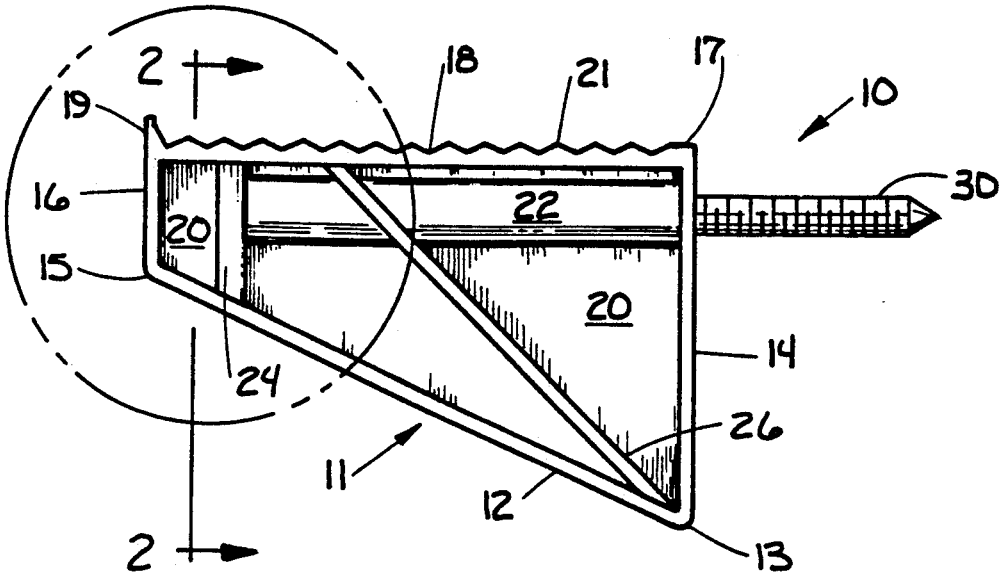
FIG. 2
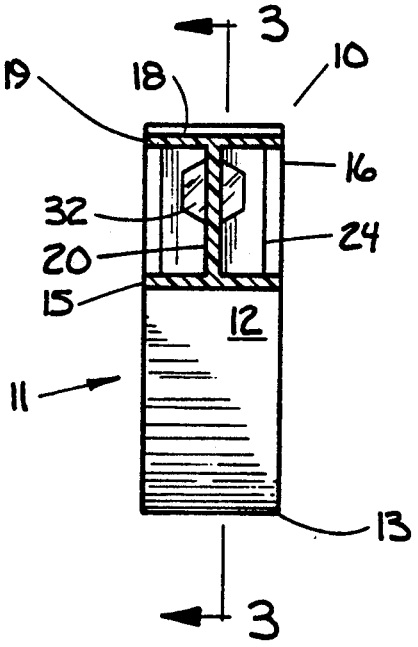
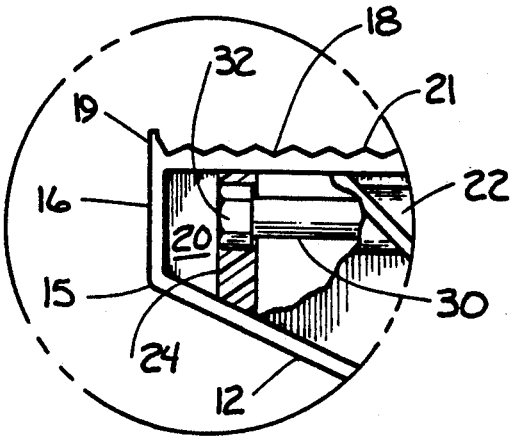
FIG. 3

FIG. 4
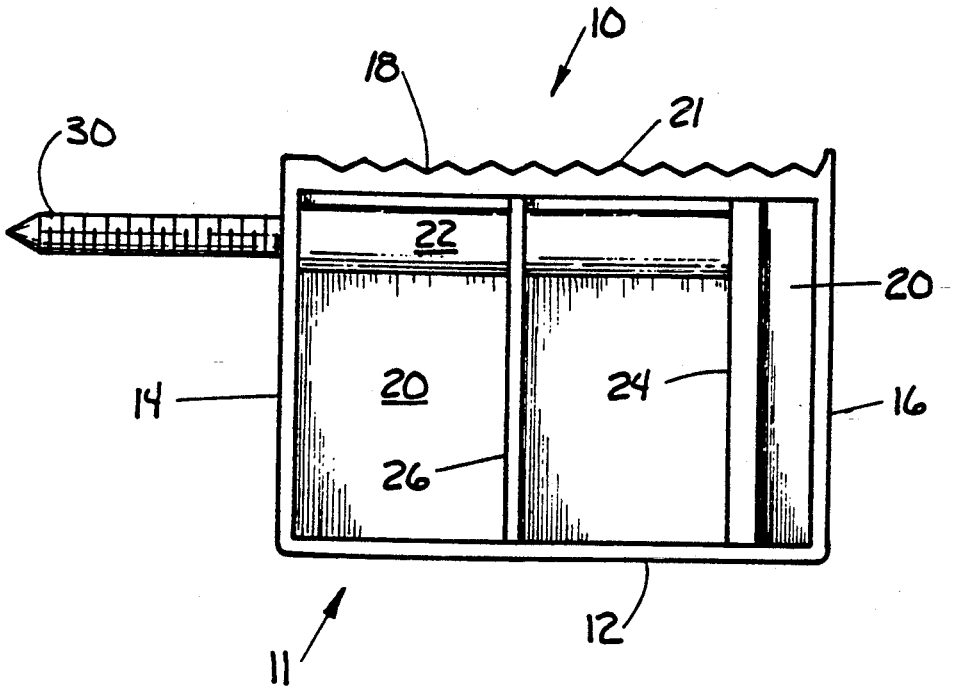
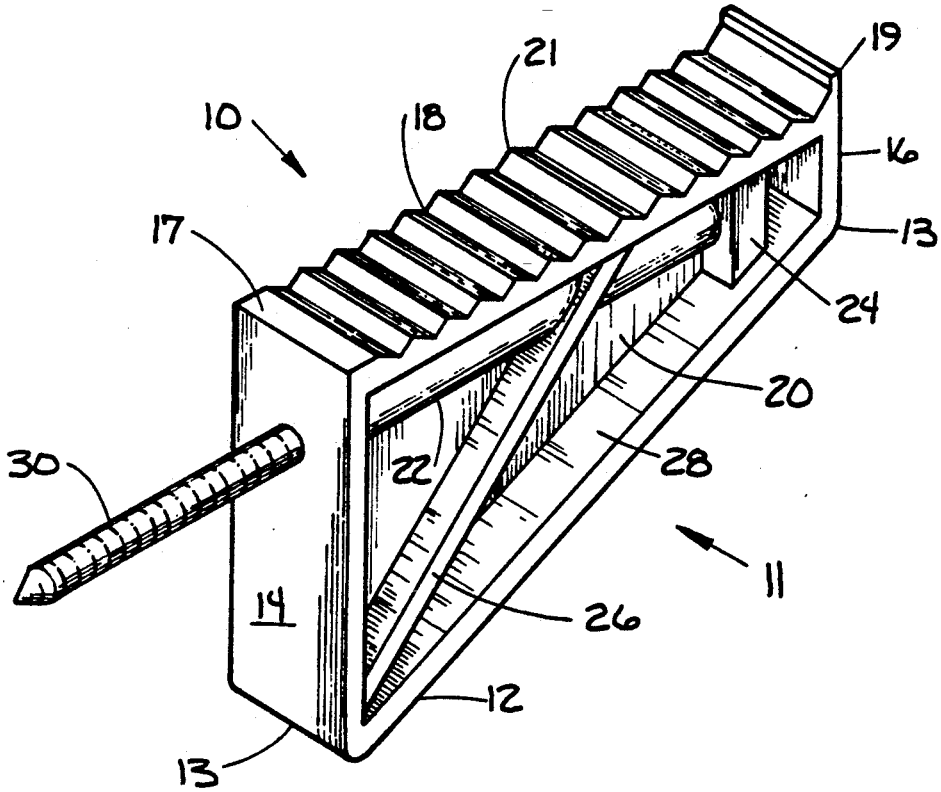
FIG. 5

TREE CLIMBER OR STEP DEVICE

FIELD OF THE INVENTION

Tree climber or step adapted to be screwed into a tree or post or the like to provide access to upper reaches thereof.

BACKGROUND OF INVENTION AND PRIOR ART

Many tree climbers or steps have been provided according to the prior art. However, these have all been characterized by numerous disadvantages. For example, they are not readily attached to or screwable into a tree or post upon which desired to be mounted. Further, they suffer from the fact that torque to be applied thereto in the mounting by screwing into a tree or post cannot be maximized, so that maximum hand pressure is frequently inadequate for the purpose of mounting the same on a selected tree or post. Also, numerous of such means have been provided in the past which failed to provide adequate contact between a portion of the step and a vertical surface of the tree or post upon which desired to be mounted, thus rendering the device less structurally stable and secure than desired after mounting of the same. Despite all these shortcomings, innumerable types and forms of tree climbers or steps, which are allegedly mountable as by screwing into a vertical surface of a tree or post, are still being promoted to the general public with their ensuing disappointing use effectiveness, stability, strength, and security. All of the foregoing shortcomings are eliminated by provision of the tree climber or step according to the present invention.

OBJECTS OF THE INVENTION

It is an object of the invention to provide a superior tree climber or step as aforesaid, which is light weight, readily transportable, and not unwieldy in form like most prior art devices. It is another object of the invention to provide such a device which can be readily screwed into a vertical surface of a tree, post, or the like upon which it is desired to be mounted. It is a further object of the invention to provide such a device having a substantially flat vertical surface at the end opposite to the screw end thereof to facilitate the exertion of maximum hand pressure during the mounting process. It is another object of the invention to provide such a device which has ridges along the top surface thereof for purposes of facilitating better footing upon the step, and moreover also a protuberance or elevation at the end thereof which will be furthest removed from the end screwed into the tree or post to provide maximum security and reduce or eliminate the risk of a foot sliding off the end of the step. Another object of the invention is the provision of such a device having an essentially flat or planar surface adjacent the exposed end of the screw to be screwed into the vertical surface of a tree or post and which will come into extremely close and touching contact with the said vertical surface of the tree or post when mounting is complete, and which provides a lower edge of said vertical surface which acts as a fulcrum for the distribution of pressure between the portion of the screw which is screwed into the tree or post and the bottom edge or corner of a body member of the device of the invention, thereby increasing the safety factor when in use. A still further object of the invention is to provide such a device which can be readily produced by the employment of a lag bolt, for example, one having a hexhead, and by molding a body portion of suitable plastic, metal, or other material of construction thereabout, preferably in a form which does not require a simple block form of body member but which may employ a rigid body member having recessed sides and optional support ribs for increasing the strength of the body member, especially an essentially vertical support rib within which the head of the lag bolt is secured by molding, the remainder of the lag bolt also being secured within the body member by molding as hereinafter described. Still other objects of the invention will be apparent to one skilled in the art, and others will become apparent as this description proceeds.

SUMMARY OF THE INVENTION

The invention, then, comprises the following, inter alia, singly or in combination:

A step particularly adapted to be mounted against an essentially vertical surface of a tree or post by screwing thereinto, comprising a body portion and a lag bolt portion, said lag bolt having a screw portion and a securable head portion, said lag bolt and said head portion thereof being secured in said body portion of said step, said body portion having an essentially horizontal upper surface and an essentially vertical planar surface adjacent to an exposed threaded portion of said lag bolt for abutment with said essentially vertical surface of said tree or post upon which desired to be mounted, and a grippable portion at the opposite end thereof to facilitate maximum hand pressure thereupon during the mounting procedure, the securable head of said lag bolt being secured within said body portion so that rotation of said body portion effectively transmits torque thereby created to the exposed threaded end of said lag bolt; such a step wherein said grippable portion comprises an essentially vertical surface portion; such a step wherein said lag bolt is mounted in said body portion nearer to said upper essentially horizontal surface thereof than to a bottom surface thereof, thereby to permit the exertion of a greater torque upon the threaded end of said lag bolt upon rotation of said body portion; such a step wherein said body portion is of molded plastic which is molded about the included portion of said lag bolt; such a step wherein said body portion is of molded plastic; such a step wherein both the reach of said body member adjacent the exposed threaded portion of said lag bolt and the reach of said body member at the opposite end of said body member comprise essentially planar vertical surfaces; such a step wherein the upper surface of said body member is an essentially horizontal planar surface provided with ridges, and wherein the juncture of said upper surface and the essentially vertical surface of said end opposite to the end adjacent to the exposed threaded portion of said lag bolt is provided with a upwardly-extending protuberance or ridge to minimize the possibility of a foot slipping off the top surface of said body member; such a step wherein the securable head of said lag bolt is secured in a reinforcing rib of said body member which is molded thereabout; such a step wherein said body member is of molded high impact plastic; such a step wherein said plastic comprises an alloy of ABS plastic and polycarbonate; and, finally, such a step wherein the proportions of ABS and polycarbonate in the plastic are between about 80 and 20 to 20 and 80.

BRIEF DESCRIPTION OF THE DRAWINGS

Reference is now made to the accompanying drawings for a better understanding of the invention, wherein FIG. 1 is a side elevational view of a tree climber or step according to the invention;

FIG. 2 is a cross-sectional view of the tree climber of the invention taken along line 2—2 of FIG. 1;

FIG. 3 is a cross-sectional view taken along line 3—3 of FIG. 2;

FIG. 4 is a side elevational view of another embodiment accordingly to the present invention;

FIG. 5 is an isometric view of the device of the present i depicted in FIG. 1 taken from the tree-abutting end thereof.

DETAILED DESCRIPTION OF THE INVENTION

Reference is now made to the drawings, wherein all of the elements are numbered and wherein the same elements are referred to by the same reference numbers throughout.

From FIG. 1, the tree-climbing device or step of the invention is seen generally at 10, with the threaded portion of lag bolt 30 protruding from molded body portion 11. Body portion 11 comprises vertical reaches 14 and 16, connected by horizontal reach 18 and diagonal reach 12, which reaches are joined to each other at corners 13, 15, 17, and 19. The non-rounded, e.g., square, rectangular, triangular, pentangular, or like non-rounded and securable head 32 of lag bolt 30, in this case a hexhead, is firmly secured by molding or the like in vertical reinforcing rib 24 of body member 11 and the remainder of lag bolt 30 is firmly secured in the metal or plastic material of construction by molding thereto of the material of construction of body member 11 along the cylindrical portion thereof as evidenced by semicylindrical protuberances 22 extending along the length of body member 11. Diagonal molded reinforcing rib 26 adds strength to the molded body portion 11. Along the top horizontal reach 18 of body member 11 are preferably provided ridges 21, for purposes of providing a better foot or sole grip on this surface 18 of the tree climber or step of the invention 10, and corner 19 is preferably provided with a peak or elevated segment to prevent a foot from slipping sidewardly off of horizontal reach 18 of the device when in use.

FIG. 4 shows another embodiment of the invention wherein the bottom reach 12 is essentially horizontal instead of tapered or diagonal as in the remaining Figures, and in addition shows a molded reinforcing rib 26, in FIG. 4 shown as having a vertical reach which, together with molded reinforcing rib 24, provides further strength and stability to body portion 11 of the device. As shown, with reinforcing rib 24 and optionally also 26, side walls 20 may be recessed, the vertical reinforcing rib 24 and semicylindrical longitudinally-extending reinforcement 22, which is molded to and about the portion of lag bolt 30 which is firmly embedded in body portion 11, providing the necessary strength and stability, especially along with one or more optional reinforcing ribs such as diagonal rib 26 (FIG. 5), providing sufficient strength and stability so that body portion 11 need not be in the form of a simple solid block of metal, plastic, or other material of construction. In such case a shelf or ledge 28 extending entirely around the various reaches of the device is present on both sides of the device, as will be apparent from the drawings and in particular from FIG. 5. In all embodiments, however, an essentially vertical reach 14 is present, in the form of a flat or planar surface adjacent to the outwardly-extending and exposed threaded portion of lag bolt 30, for close abutment with the vertical surface of the tree or post to which the tree climber or step is to be attached. Conversely, at the opposite end of the device, grippable reach 16, also preferably in the form of a flat or planar surface, is provided, so as to permit the exertion of maximum hand-pressure against the device while urging the threaded portion of lag bolt 30 into the tree or post to which the device is to be attached.

In operation, the device of the invention is positioned with the outwardly-extending portion of lag bolt 30 in touching contact with a vertical surface of the tree or post to which the device is to be attached and, by the exertion of hand pressure against flat or planar reach 16 at the end of the device opposite to flat or planar reach 14, maximum hand pressure is exerted at the point of introduction of the threaded portion of lag bolt 30. Moreover, because of the location of lag bolt 30 with respect to vertical reach 14 of the device, that is, near the top or upper edge thereof, there is an ample flat surface at opposing reach 16 for the exertion of maximum hand pressure thereon, as well as a sufficient reach of opposing flat or planar surface 16 as well as adjacent flat or planar vertical surface 14 below lag bolt 30 for the exertion of maximum torque upon t e threaded portion of lag bolt 30 while inserting the same into the tree or post upon which it is desired that the device be mounted. Further, due to the positioning of the lag bolt near the top or upper edge of essentially vertical planar surface 14 adjacent to the threaded end of lag bolt 30, when the device of the invention has been sufficiently screwed into the tree or post upon which to be mounted, the proximity of flat or planar surface 14 adjacent to the threaded portion of lag bolt 30 and disposed vertically therebeneath provides a tight fit of the essentially planar surface of reach 14 against the tree or post to which the device is attached, with lower corner or edge 13 providing a fulcrum for distribution of the torque between the threaded portion of lag bolt 30 and corner or edge 13 when the weight of a climber is placed upon top reach or surface 18 of the device of the invention.

It is accordingly seen that a superior and advantageous tree climber or step has been provided, which has all of the characteristics and advantages as previously enumerated, and whereby all of the objectives of the present invention have been fulfilled.

In actual practice, various castable or moldable plastics have been found particularly suitable and advantageous for production of body portion 11, especially a highimpact plastic, e.g., polystyrene, ABS, or polycarbonate (PC), and in particular an alloy or mixture of ABS and polycarbonate (PC) plastics, preferably in a range between about 80 and 20 to 20 and 80, has been found particularly suitable, these plastic alloys being readily available in the trade, although any other plastic or metal materials providing suitable strength and stability may of course be employed with equal facility for production of body member 11 of the device of the invention.

It is to be understood that the present invention is not to be limited to the exact details of operation or elements or materials of construction, whether metal, plastic, or the like, or to the exact compositions, methods, procedures, or embodiments shown and described, as various modifications and equivalents will be immediately apparent to one skilled in the art, wherefore the present invention is to be limited only by the full scope which can be legally accorded to the appended claims.

We claim:

1. A unitary one-piece step particularly adapted to be mounted against an essentially vertical surface of a tree of post by screwing thereinto, comprising a body portion of molded high impact plastic in the form of a solid block having recessed side walls and at least one reinforcing rib and comprising a shelf or ledge extending entirely around the various reaches of the block on both sides of the device extending outwardly from said recessed side walls, and a lag bolt portion, said lag bolt having a screw portion and a securable head portion, said lag bolt and said head portion thereof being molded into said body portion of said step, said body portion having an essentially horizontal upper surface and an essentially vertical planar surface adjacent to an exposed threaded portion of said lag bolt for abutment with said essentially vertical surface of said tree or post upon which desired to be mounted, and a grippable portion comprising an essentially planar vertical surface portion at the opposite end thereof to facilitate maximum hand pressure thereupon during the mounting procedure, the securable head of said lag bolt being molded into said body portion so that rotation of said body portion effectively transmits torque thereby created to the exposed threaded end of said lag bolt, wherein said lag bolt is molded into said body portion nearer to said upper essentially horizontal surface thereof than to a bottom surface thereof, thereby to permit the exertion of a greater torque upon the threaded end of said lag bolt upon rotation of said body portion for mounting thereof by simple rotation while maintaining maximum hand pressure upon the essentially planar vertical surface portion of the grippable portion at the end thereof opposite to the threaded portion of said lag bolt, said body portion having a rectangular or triangular shape when viewed from the side.

2. A step of claim 1, wherein the upper surface of said body member is an essentially horizontal planar surface provided with ridges, and wherein the juncture of said upper surface and the essentially vertical surface of said end opposite to the end adjacent to the exposed threaded portion of said lag bolt is provided with a upwardly-extending protuberance or ridge to minimize the possibility of a foot slipping off the top surface of said body member.

3. The step of claim 1, wherein the securable head of said lag bolt is secured in a reinforcing rib of said body member which is molded thereabout.

4. A step of claim 1, wherein said plastic comprises an alloy of ABS plastic and polycarbonate.

5. A step of claim 4, wherein the proportions of ABS and polycarbonate in the plastic are between about 80 and 20 to 20 and 80.

* * * * *

UNITED STATES PATENT AND TRADEMARK OFFICE

CERTIFICATE OF CORRECTION

PATENT NO. : 5,279,388

DATED : Jan. 18, 1994

INVENTOR(S) : Michael K. Laughlin, Jerry K. Laughlin, Victor A. Laughlin

It is certified that error appears in the above-indentified patent and that said Letters Patent is hereby corrected as shown below:

Title page, column 2, line 1; "Kubrak" should read
-- Kubiak --.
Column 3, line 21,22; "present i depicted" should read
-- present invention depicted --.
Column 4, line 36; "upon t e" should read -- upon the --.
Column 4, line 62; "highimpact" should read
-- high-impact --.

Signed and Sealed this

Twenty-third Day of August, 1994

*Attest:*

Bruce Lehman

BRUCE LEHMAN

*Attesting Officer*

*Commissioner of Patents and Trademarks*